United States Patent [19]

Chylinski

[11] Patent Number: 4,608,782

[45] Date of Patent: Sep. 2, 1986

[54] METHOD AND APPARATUS FOR SHARPENING RAZOR BLADES

[75] Inventor: Henryk J. Chylinski, Haverhill, Mass.

[73] Assignee: The Gillette Company, Boston, Mass.

[21] Appl. No.: 735,335

[22] Filed: May 17, 1985

[51] Int. Cl.[4] ..... B24B 9/00

[52] U.S. Cl. ..... 51/80 B; 51/285

[58] Field of Search ..... 51/87 BS, 80 B, 74 BS, 51/80 BS, 80 B, 81 BS, 92 BS, 76 BS, 285, 77 BS; 76/DIG. 8; 30/34 R, 48, 49, 50, 346.56, 346.61, 346.55, 355

[56] References Cited

U.S. PATENT DOCUMENTS

| | | | |
|---|---|---|---|
| 1,579,577 | 4/1926 | Thompson . | |
| 2,043,998 | 6/1936 | Hadjopoulos . | |
| 2,697,951 | 12/1954 | Muller | 76/104 |
| 3,654,701 | 4/1972 | Hastings, Sr. | 30/346.56 |
| 3,872,588 | 3/1975 | Bogaty | 30/50 |
| 3,897,629 | 8/1975 | Liedtke | 30/30 |
| 4,094,066 | 6/1978 | Daniel, Jr. | 30/346.53 |
| 4,265,055 | 5/1981 | Cartwright et al. | 51/87 BS X |

FOREIGN PATENT DOCUMENTS

| | | | |
|---|---|---|---|
| 485950 | 5/1938 | United Kingdom | 30/355 |
| 1334018 | 9/1971 | United Kingdom . | |
| 2108887 | 12/1981 | United Kingdom . | |

*Primary Examiner*—Frederick R. Schmidt
*Assistant Examiner*—Maurina Rachuba

[57] ABSTRACT

Apparatus for forming a sharpened edge on a razor blade or the like includes structure for passing a blade element on which it is desired to form a sharpened edge along a path, and abrading structure mounted adjacent the path for forming a primary sharpened edge on the blade element. a secondary sharpened edge forming stage includes secondary edge forming apparaus mounted for rotation adjacent the path, the secondary edge forming apparatus having a helical abrading land formed thereon for forming spaced recesses in at least one of the facets that define the primary edge along the length of the sharpened primary edge. The blade element is advanced along the sharpening path and the secondary edge forming apparatus is rotated in synchronism with the advance of the blade element to abrade a series of spaced recesses along the primary sharpened cutting edge, those recesses providing secondary sharpened cutting edge portions spaced at regular intervals along the primary sharpened cutting edge and the primary and secondary sharpened cutting edge portions forming an essentially continuous undulating sharpened cutting edge in a razor blade or the like.

7 Claims, 7 Drawing Figures

FIG 1
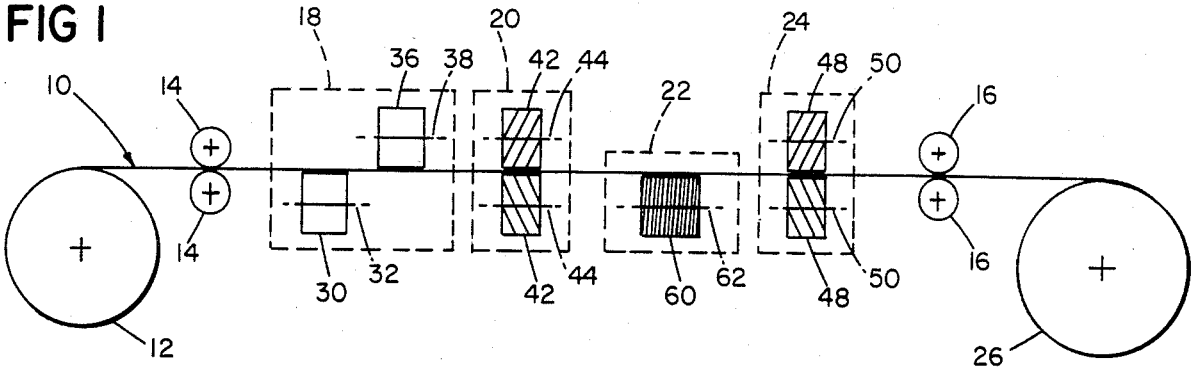
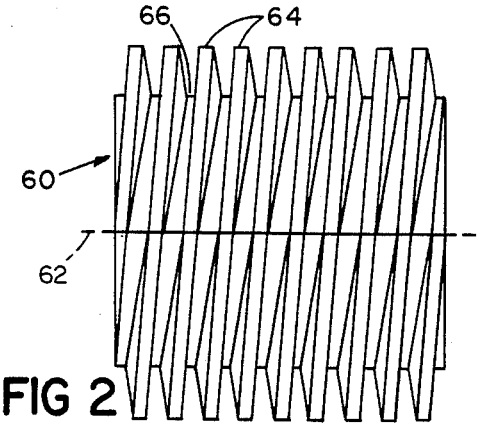
FIG 2
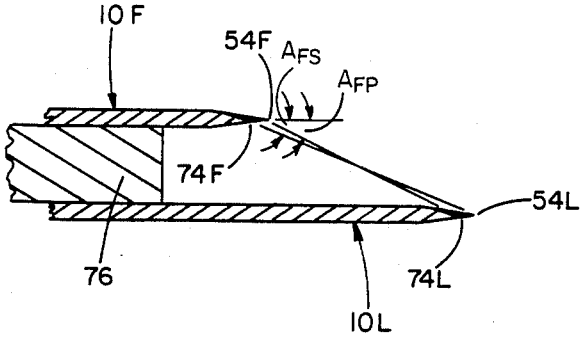
FIG 7
FIG 4
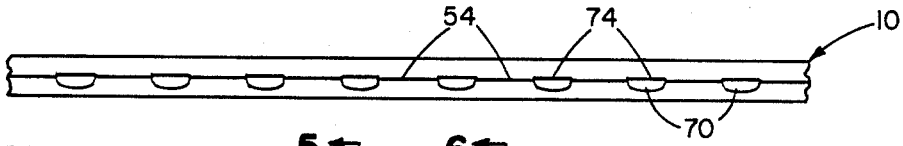
FIG 3
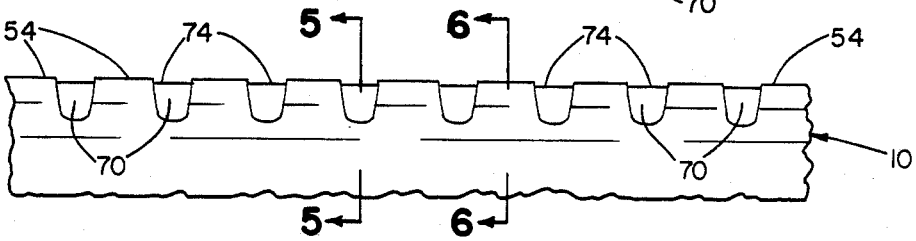
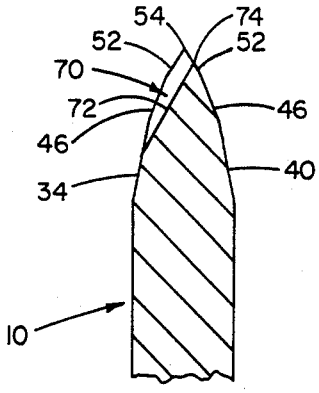
FIG 5
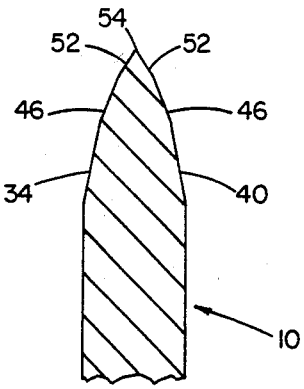
FIG 6

METHOD AND APPARATUS FOR SHARPENING RAZOR BLADES

This invention relates to methods and apparatus for forming a cutting edge on a razor blade or similar cutting tool, and to improved razor blades.

The sharpening of razor blades by mass production techniques conventionally involves a series of abrading operations (grinding and honing) to produce the desired sharp and durable shaving edge. Each abrading operation forms a facet on the blade edge being sharpened, which facet is modified by subsequent abrading operations of increasing fineness. In general, the blade edge configuration is of wedge shape, the facets defining the ultimate sharpened edge typically having an included solid angle in the range of 20°–30°. The facets or sides of such cutting edges may extend back from the ultimate edge a distance of up to two millimeters or even more.

A number of proposals have been made to provide a razor blade with a cutting edge that has a notched or undulating configuration, alternating cutting and non-cutting portions, or edges of sinusoidal or serpentine shape. In general, such proposals have not been considered commercially practical, due perhaps to factors such as cost of manufacture or reduced shaving effectiveness.

In accordance with one aspect of the invention, there is provided apparatus for forming a sharpened edge on a cutting tool that includes guide structure for passing a cutting tool element on which it is desired to form a sharpened edge along a path, and abrading means mounted adjacent the path for forming a primary sharpened edge on the cutting tool element. A secondary sharpened edge forming stage includes secondary edge forming apparatus mounted for rotation adjacent the path, the secondary edge forming apparatus having a helical abrading land formed thereon for forming spaced recesses in at least one of the facets that define the primary edge along the length of the sharpened primary edge, and means for advancing the cutting tool element along the sharpening path and rotating the secondary edge forming apparatus in synchronism with the advance of the cutting tool element to abrade a series of spaced recesses along the primary sharpened cutting edge, those recesses forming secondary sharpened cutting edge portions spaced at regular intervals along the primary sharpened cutting edge. The primary and secondary sharpened cutting edge portions form an essentially continuous undulating sharpened cutting edge along an edge of a razor blade or other cutting tool element.

In preferred embodiments for forming sharpened edges on razor blades, the abrading means includes a grinding stage with a first set of abrading wheels mounted adjacent the path for forming a first set of facets adjacent the edge of the cutting tool element to be sharpened, a first joning stage with a second pair of abrading wheels mounted adjacent the path for modifying the first set of facets and forming a second set of facets on the edge of the cutting tool element and a second honing stage with a second pair of abrading wheels mounted adjacent the path for modifying the second set of facets and forming the primary sharpened cutting edge of the cutting tool element. The secondary edge forming wheel is mounted adjacent the sharpening path between the first and second honing stages, and its helical land has a width of less than one-half centimeter and a pitch of less than one centimeter. The recesses formed by the secondary edge forming wheel modify at least a portion of the second facet. A secondary edge forming wheel may be located on one side of the sharpening path to form a series of recesses on one side of the razor blade element along its primary sharpened edge or secondary edge forming wheels may be located on opposite sides of the sharpening path to form a series of recesses on each of the opposed sides of the razor blade element.

In accordance with another aspect of the invention, there is provided a razor blade with a primary sharpened edge defined by opposed facets and a series of spaced abraded recesses at regular intervals along the primary sharpened edge in at least one of the facets. The recesses for secondary sharpened cutting edge portions that are parallel to and spaced at regular intervals along the primary sharpened cutting edge, and the primary and secondary sharpened cutting edge portions form an essentially continuous undulating sharpened cutting edge along an edge of said razor blade. Such razor blades may be used in single or multiple edge shaving units, and provide effective shaving geometry configurations.

In preferred embodiments, the primary sharpened edge of the razor blade is defined by a first pair of grind facets that have an included angle in the range of 10°–15°, a second pair of facets that have an included angle in the range of 13°–18°, and a pair of final facets that have an included angle in the range of 20°–32° and that define the primary sharpened edge, and each abraded recess that forms a secondary cutting edge portion modifies a facet of the second pair and has a facet of greater inclination than the unmodified second facet. Each secondary edge portion has a length in the range of one-half–five millimeters, is recessed a distance in the range of ten–one hundred micrometers below the primary sharpened edge and is offset (in the plane of the blade) a distance in the range of two–twenty micrometers from the primary sharpened edge; and adjacent secondary edge portions are spaced apart a distance of less than one centimeter.

In accordance with another aspect of the invention, a method for sharpening the edge of a cutting tool includes the steps of forming a primary sharpened edge on the cutting tool element, disposing an abrading wheel that has a helical abrasive land formed on its cylindrical surface for rotation about an axis generally parallel to a sharpening path, and moving the cutting tool element along the sharpening path in synchronism with the rotation of the abrading wheel to abrade a series of spaced recesses in the primary sharpened edge. The recesses form secondary sharpened cutting edge portions spaced at regular intervals along the primary sharpened cutting edge, and the primary and secondary sharpened cutting edge portions form an essentially continuous undulating sharpened cutting edge on the cutting tool element.

In a preferred embodiment, the steps of forming a primary sharpened edge on the cutting tool element include the steps of forming a first pair of grind facets that have an included angle in the range of 10°–15°, forming a second pair of facets that have an included angle in the range of 13°–18°, and then forming a pair of final facets that have an included angle in the range of 20°–32° and that define the primary sharpened edge; the recesses that form the secondary cutting edge portions modifying a facet of said second pair and having a facet of greater inclination than the unmodified second facet.

Other features and advantages of the invention will be seen as the following description of a particular embodiment progresses, in conjunction with the drawings, in which:

FIG. 1 is a diagrammatic top view of razor blade sharpening apparatus in accordance with the invention;

FIG. 2 is a diagrammatic side view of an abrading wheel in accordance with the invention;

FIG. 3 is a diagrammatic front view of a razor blade sharpened in accordance with the invention;

FIG. 4 is a diagrammatic top view of the razor blade shown in FIG. 3;

FIGS. 5 and 6 are sectional diagrammatic views (taken along the lines 5—5 and 6—6 respectively of FIG. 3) of the sharpened razor blade; and FIG. 7 is a diagrammatic view of portions of a tandem edge razor with razor blades of FIGS. 3–6.

DESCRIPTION OF PARTICULAR EMBODIMENT

There is shown in diagrammatic form in FIG. 1 apparatus for sharpening the edge of a razor blade in accordance with the invention. The razor blade stock 10, which in this embodiment is in continuous strip form of uniform width and about 0.1 millimeter thickness, has an upper edge which is to be sharpened. Strip 10 is fed from supply reel 12 along a sharpening path between guide rolls 14 and drive rolls 16 through grinding stage 18, rough hone stage 20, secondary edge forming stage 22 and final hone stage 24 to take up reel 26. Abrading wheel 30 is mounted for rotation about axis 32 at grinding stage 18 for forming a first grind facet 34 (FIGS. 5 and 6) on blade strip 10, and abrading wheel 36 is mounted for rotation about axis 38 at grinding stage 18 for forming a similar grind facet 40 on the rear side of strip 10. The blade strip 10 is then subjected to rough honing by a pair of juxtaposed rougher wheels 42 mounted for rotation about axes 44 to form a set of rough hone facets 46 on opposite sides of blade strip 10. Similarly, the juxtaposed abrading wheels 48 that are mounted on rotation about axes 50 at final honing stage 24 form a pair of final facets 52 that define a primary sharpened edge 54 on blade strip 10. The razor blade strip is driven at uniform speed along the sharpening path in suitable manner as indicated diagrammatically by the take up rolls 16. Razor blade sharpening equipment of this general type is well known in the art, an example of such equipment being illustrated and described in Dellafontaine U.S. Pat. No. 2,709,874, and reference may be had thereto for illustration and description of constructional details of this general type of equipment. In this embodiment, the abrading wheels 30 and 36 at grinding stage 18 are composed of a phenolic base with 240 grit silicon carbide and are controlled to grind strip 10 to form facets 34 and 40 at an included angle of about 12°; and abrading wheels 42 at rough honing stage 20 are composed of a phenolic base with 600 grit silicon carbide and are controlled to smooth the upper portions of facets 34 and 40 to form second facets 46 that have an included angle of about 16° and a length of about 0.15 millimeter. The abrading wheels 48 at final honing stage 24 are composed of a viscoelastic material such as polyimide with 1000 grit aluminum oxide and form the final facets 52 in upper portions of facets 46 that have an included angle of about 26° and that define primary edge 54.

Secondary edge forming stage 22 has a phenolic base abrading wheel 60 that is manufactured of a suitable grade of abrasive material such as silicon carbide, alumina, diamond, or a combination of such materials, and is of grit similar to that of rougher wheels 42. Wheel 60, in this embodiment, has a length of about fifteen centimeters and a diameter of about fifteen centimeters, and is mounted on a spindle that in turn is mounted in suitable bearing blocks (not shown) for rotation about axis 62 parallel to the direction of travel of blade strip 10. Formed in wheel 60, as diagrammatically indicated in FIG. 2, is a helical land 64 that has a width of about one millimeter, adjacent lands 64 being spaced by helical recess 66 that has a width of about 1.5 millimeters and a depth of about four centimeters to provide a land pitch of about 2.5 millimeters.

Secondary edge forming wheel 60 is driven in rotation at 3600 rpm, so that abrading land 64 advances at a rate of about nine meters per minute. Strip drive 16 is operated to advance strip 10 in the same direction at the same speed (nine meters per minute) to generate a series of spaced recesses 70 in facets 34 and 46 (of configuration as shown in FIGS. 3–5) that have facet surfaces 72 at an angle of about 10° to the plane of strip 10 (as indicated in FIG. 5) and provide secondary edge portions 74 that are recessed and offset (relative to the plane of strip 10) from the primary edge 54. The ultimate edges 74 of the recesses 70 are honed by the final honing wheel 48. Each secondary edge undulation 74 has a length of about one millimeter, and is offset from edge 54 (as viewed in FIG. 4) about seven micrometers; and is about fifty micrometers below primary edge 54 (as viewed in FIGS. 3 and 5).

Portions of a tandem edge razor of the type shown in U.S. Pat. No. 3,786,563 with two razor blades of the type shown in FIGS. 3–6 are diagrammatically illustrated in FIG. 7. Leading blade 10L is spaced from following blade 10F by spacer 76. The primary and secondary edges 54, 74 of blades 10L and 10F provide a range of shaving geometries, as indicated by the two following blade tangent angles $A_{FP}$ and $A_{FS}$ of following blade 10F - angle $A_{FP}$ being about two degrees greater than angle $A_{FS}$. Similarly, the edges 54 and 74 have different exposures, and the resulting primary and secondary shaving geometries of the two blades 10L and 10F interact in an undulating manner during a shaving stroke to provide effective shaving with a range of blade tangent angles and exposures.

While a particular embodiment of the invention has been shown and described, various modifications thereof will be apparent to those skilled in the art, and therefore it is not intended that the invention be limited to the disclosed embodiment or to details thereof, and departures may be made therefrom within the spirit and scope of the invention.

What is claimed is:

1. Cutting tool sharpened edge forming apparatus comprising guide structure for passing a cutting tool element on which it is desired to form a sharpened edge along a path, abrading means mounted adjacent said path for forming a primary sharpened edge on the cutting tool element, a secondary sharpened edge forming stage including a secondary edge forming wheel mounted for rotation adjacent said path, said secondary edge forming wheel having a helical abrading land formed thereon for forming spaced recesses along the length of said sharpened edge, and means for advancing the cutting tool element along said sharpening path and rotating said secondary edge forming wheel in synchronism with the advance of said cutting tool element along said sharpening path to abrade a series of spaced recesses along said primary sharpened cutting edge of the cutting tool element, said recesses forming secondary sharpened cutting edge portions spaced at regular intervals along said primary sharpened cutting edge, and said primary and secondary sharpened cutting edge portions forming an essentially continuous undulating sharpened cutting edge along said cutting tool element.

2. The apparatus of claim 1 wherein said abrading means includes a grinding stage including a first set of abrading wheels mounted adjacent the path for forming a first set of facets adjacent the edge of the cutting tool element to be sharpened, a first honing stage including a second pair of abrading wheels mounted adjacent the path for modifying the first set of facets and forming a second set of facets on the edge of the cutting tool element, and a second honing stage including a second pair of abrading wheels mounted adjacent the path for modifying the second set of facets and forming said primary sharpened cutting edge of the cutting tool element.

3. The apparatus of claim 2 wherein said secondary edge forming wheel is mounted adjacent the sharpening path between the first and second honing stages.

4. The apparatus of claim 1 wherein said helical land of said secondary edge forming wheel has a width of less than one-half centimeter and a pitch of less than one centimeter.

5. A method for sharpening the edge of a cutting tool comprising the steps of forming a primary sharpened edge on the cutting tool element, disposing an abrading wheel that has a helical abrasive land formed on its cylindrical surface for rotation about an axis generally parallel to a sharpening path, and moving said cutting tool element along said sharpening path in synchronism with the rotation of said abrading wheel to abrade a series of spaced recesses in said primary sharpened edge, said recesses forming secondary sharpened cutting edge portions spaced at regular intervals along said primary sharpened cutting edge, and said primary and secondary sharpened cutting edge portions forming an essentially continuous undulating sharpened cutting edge on said cutting tool element.

6. The method of claim 5 wherein said step of forming a primary sharpened edge on the cutting tool element includes the steps of forming a first pair of grind facets that have an included angle in the range of 10°–15°, a second pair of facets that have an included angle in the range of 13°–18°, and a pair of final facets that define said primary sharpened edge.

7. The method of claim 6 wherein said recesses that form said secondary cutting edge portions modify a facet of said second pair and have a facet of greater inclination than the unmodified second facet.

* * * * *